US006001032A

United States Patent [19]

Onuki et al.

[11] Patent Number: 6,001,032

[45] Date of Patent: Dec. 14, 1999

[54] GOLF CLUB HEAD

[75] Inventors: Masahide Onuki, Miki; Akio Ohnishi, Kakogawa, both of Japan

[73] Assignee: Sumitomo Rubber Industries, Ltd., Kobe, Japan

[21] Appl. No.: 09/099,063

[22] Filed: Jun. 16, 1998

[30] Foreign Application Priority Data

Jul. 24, 1997 [JP] Japan ..... 9-215599

[51] Int. Cl.[6] ..... A63B 53/04

[52] U.S. Cl. ..... 473/342; 473/345; 473/350

[58] Field of Search ..... 473/329, 332, 473/342, 345, 350

[56] References Cited

U.S. PATENT DOCUMENTS 5,398,929 3/1995 Kitaichi .
5,720,673 2/1998 Anderson .
5,816,936 10/1998 Aizawa .

FOREIGN PATENT DOCUMENTS 5-337222 12/1993 Japan .
6-165843 6/1994 Japan .
6-182006 7/1994 Japan .
7-255884 10/1995 Japan .
8-252344 10/1996 Japan .

*Primary Examiner*—Sebastiano Passaniti
*Attorney, Agent, or Firm*—Armstrong, Westerman, Hattori, McLeland & Naughton

[57] ABSTRACT

A concave portion to which a face body is fitted is formed on a face side of a head main body. A concave groove is formed along an inner peripheral surface of the concave portion as to leave a side wall of a small thickness dimension. A caulking member is press-fitted into the concave groove. The side wall is deformed to the face body by lateral pressure of the caulking member, tightly fitted to the face body, and to hold the face body.

10 Claims, 7 Drawing Sheets

GOLF CLUB HEAD

BACKGROUND OF THE INVENTION

1. Field of the Invention

This invention relates to a golf club head.

2. Description of the Related Art

Conventionally, as methods for fixing a golf club head main body and a face body which is fitted to a concave portion of a face side of the head main body, techniques of ① through ⑤ described below are known.

① Japanese Patent Provisional Publication No. 6-165843 discloses a golf club head in which a face body is fixed to a head main body through metal members for connection.

② Japanese Patent Provisional Publication No. 6-182006 discloses a golf club head in which a concave portion is formed on a face body, a convex portion which fits to the concave portion is formed on a head main body with plastic deformation, and the face body is fixed to the head main body.

③ Japanese Patent Provisional Publication No. 5-337222 discloses a golf club head in which a peripheral face of a concave portion of a head main body to which a face body is attached is formed with a reverse-tapered configuration as to be wider at a back side, and the face body is press-fitted to the concave portion with plastic deformation and fixed to the head main body.

④ Japanese Patent Provisional Publication No. 7-255884 discloses a golf club head in which pins are applied to a concave portion of a head main body to which a face body is fitted, pin holes where the pins go through are disposed on the face body, and the face body is fixed to the head main body with caulking the pins.

⑤ Japanese Patent Provisional Publication No. 8-252344 discloses a golf club head in which a caulking member is applied to an aperture between an inner face of a concave portion of a head main body and a circumference of a face body, and the face body is fixed to the head main body with plastic deformation of the caulking member.

In recent years, golf clubs in which dissimilar (different) metals are combined have been attracting public attention. As effects of using dissimilar metals, increase of degree of freedom in weight distribution, efficient use of small amount of expensive materials (such as titanium alloy, etc.), proper selection of materials corresponding to requirement characteristics of each part of a head (strength, rigidity, wear rate, etc.), and external beauty, are thinkable. To realize a combination head made of dissimilar metals as described above, various methods for fixing a face body to a head main body have been proposed as described above.

Problems described below, however, still remain unsolved.

That is to say, in case that titanium alloy, which is attracting attention as a head material, is used for a head main body or a face body, and a material which is difficult to be worked plastically (such as pure titanium, tungsten, ceramic, amorphous metal, etc.) is used for the other, it is difficult to fix the face body to the head main body by fixing methods with plastic deformation shown in above described ② and ③. Because titanium and titanium alloy have high deformation resistance in plastic deformation, bad dimension accuracy for their high spring back, and are considerably difficult to be worked plastically in comparison with conventional materials. And if titanium and titanium alloy are forced to be fixed with plastic deformation (caulking), gaps may be generated by relieves of caulked parts.

In fixing methods of ① and ④, a face body can be fixed to a head main body when they are made of materials which is difficult to be plastically deformed, since the fixation is conducted with metal members for connection or pins. In these methods, however, number of parts increases for necessity of the metal members for connection, the pins, and the pin holes to which the pins are inserted. This increases parts preparation time and number of assemble processes, production efficiency becomes worse, and production cost becomes higher thereby.

In fixing methods of ⑤ in which the face body and the head main body are connected by plastic deformation of the caulking member applied to the aperture between the inner face of the concave portion of the head main body and the circumference of the face body, although a head main body and a face body made of materials which are difficult to be plastically deformed can be fixed, following problems still remain.

That is to say, one of the problems is that impact force when the club head hits a golf ball generates elastic deformation in the face body, and the club head is damaged by deformation and rubbing of the caulking member, of which material is easily deformed plastically, filling the gap between the inner face of the concave portion of the head main body and the circumference of the face body. And the other problem is that gaps are generated between the caulking member and the face body.

It is therefore an object of the present invention to provide a golf club head that realizes fixation of a face body in which a head main body and a face body made of low plasticity materials are fixed with high working efficiency, beautiful finish, high durability, and without generation of damage and gaps.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
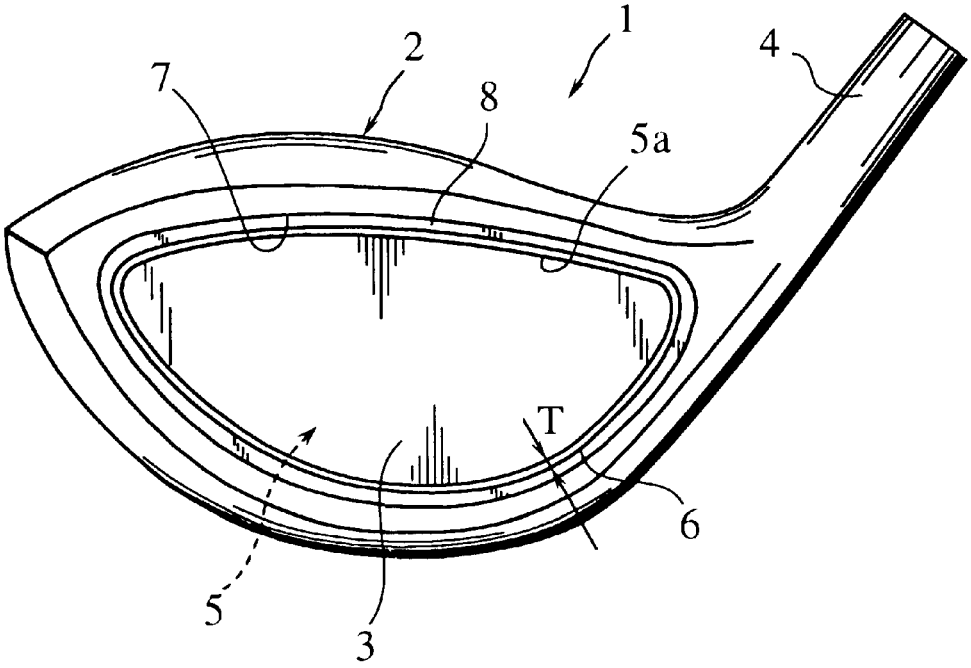
FIG. 1 is a front view showing a preferred embodiment of the present invention.
Figure 2:
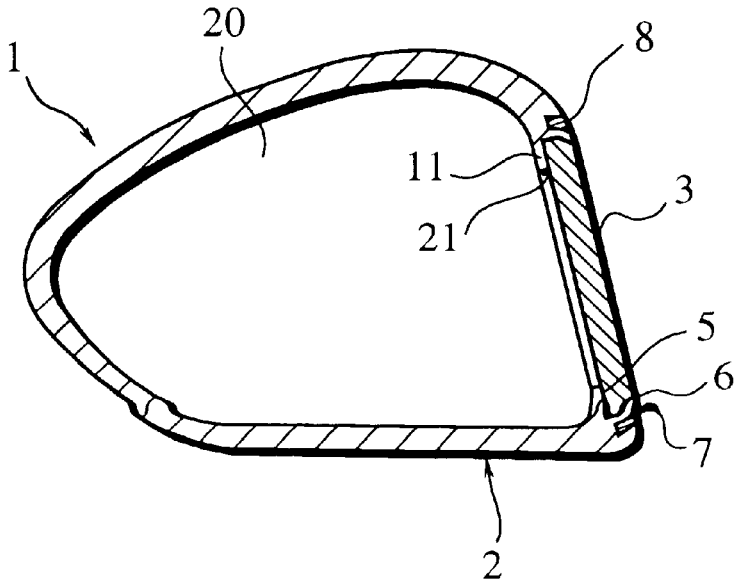
FIG. 2 is a cross-sectional view showing a preferred embodiment of the present invention.
Figure 3A:
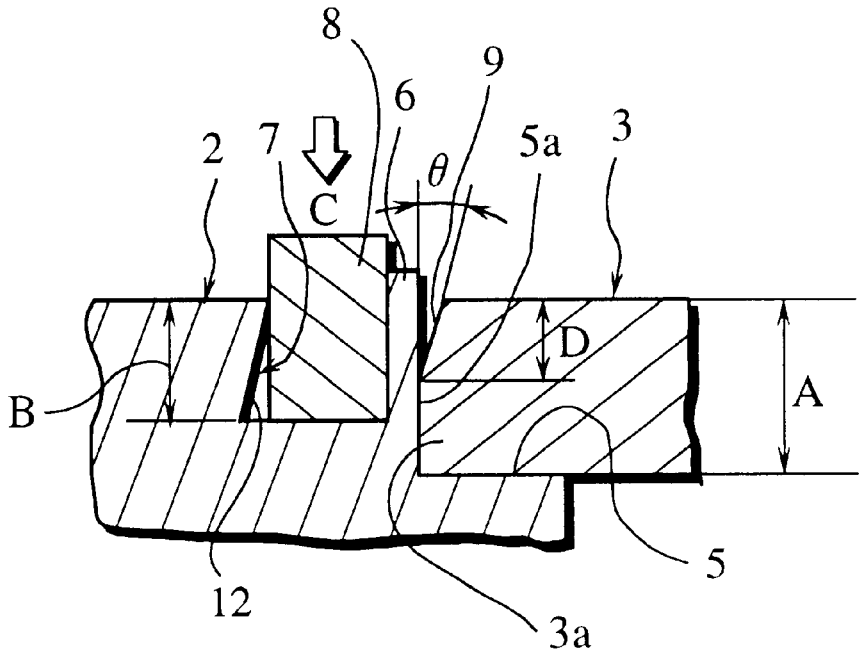
FIG. 3A is an explanatory cross-sectional view of an enlarged principal portion showing a preferred embodiment of the present invention.
Figure 3B:
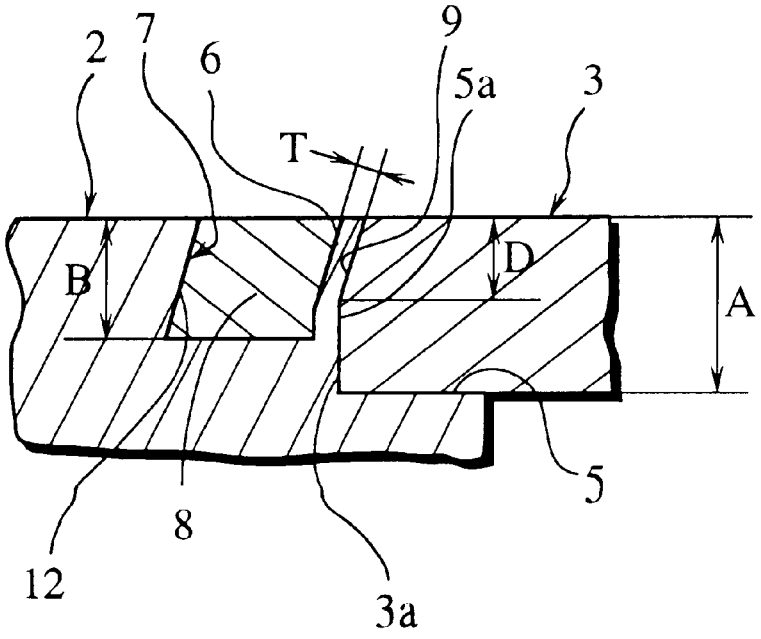
FIG. 3B is an explanatory cross-sectional view of an enlarged principal portion showing a preferred embodiment of the present invention.

FIG. 1 is a front view showing an embodiment of the present invention applied to a wood type golf club head. FIG. 2 is a longitudinal section of the embodiment of FIG. 1. FIGS. 3A and 3B are explanatory cross-sectional views of an enlarged principal portion. And FIGS. 3A and 3B are explanatory views of manufacturing method at the same time.

As shown in FIG. 1 through FIG. 3B, in this golf club head 1, a head main body 2 and a face body 3, which occupies a part of a face, are made of similar (same) or dissimilar (different) materials, and a neck portion 4, which is connected with a golf club shaft (not shown in Figures), is integrally formed with the head main body 2.

A shallow concave portion 5 to which the face body 3 (insert plate) fits is formed on a face side of the head main body 2, and a concave groove 7 is formed with a side wall 6 of small thickness dimension T along an inner peripheral surface 5*a* of the concave portion 5. A caulking member 8 is press-fitted to the concave groove 7 and worked with plastic deformation, the side wall 6 is deformed to a chamfer 9 of a peripheral portion 3*a* of the face body 3, and the head main body 2 and the face body 3 are connected and fixed.

To explain in further detail, (as shown in FIG. 2) a window portion 21, which opens to a hollow chamber portion 20, is formed on a face wall of the head main body 2. An inner brim portion 11 protrudes from an inner peripheral face of the window portion 21, and the former-described face body 3 is fitted to the shallow concave portion 5 of which bottom is the inner brim portion 11. And, the window portion 21 on the face wall may be omitted, and the concave portion 5 may be formed as to be an entirely closed shallow dish on an outer face of the face wall (not shown in Figures).

Figure 7:
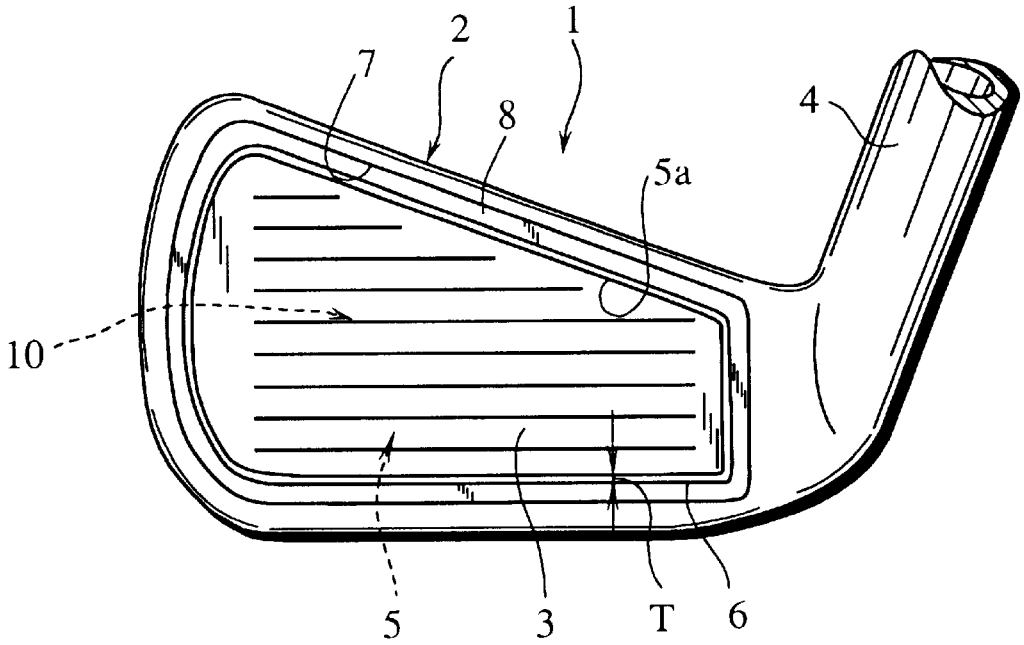
FIG. 7 is a front view showing another preferred embodiment of the present invention.
Figure 8:
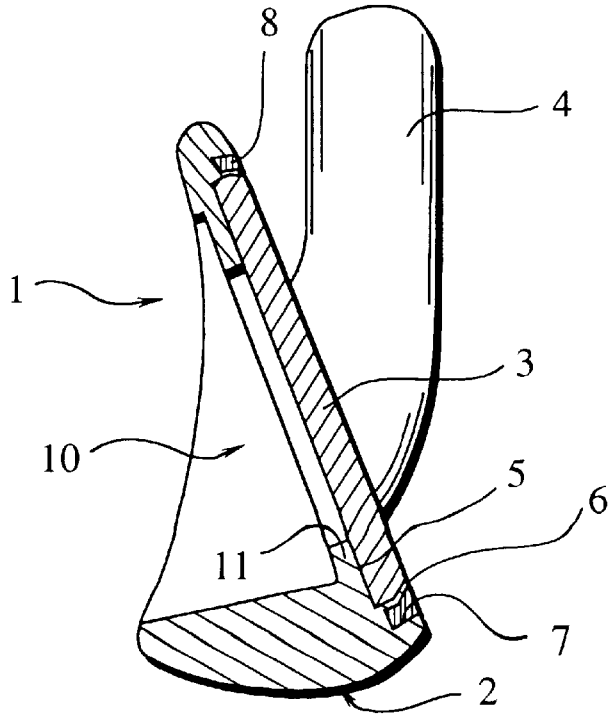
FIG. 8 is a cross-sectional view showing another preferred embodiment of the present invention.

Further, the present invention, of which application is not restricted to wood type golf club heads, can be applied to iron type golf club heads as another embodiment shown in FIG. 7 and FIG. 8.

In FIG. 7 and FIG. 8, parts of same marks representing same parts in FIG. 1 and FIG. 2 are similarly constructed as in a case of FIG. 1 and FIG. 2, and explanation of these parts is omitted. In this iron type golf club head, a hollow portion 10, which goes through a face side and a back side of a head main body 2, is formed in the head main body 2, an inner brim portion 11 protrudes from an inner peripheral surface of the hollow portion 10, and a face body 3 fits to a shallow concave portion 5 of which bottom is the inner brim portion 11.

Figure 9:
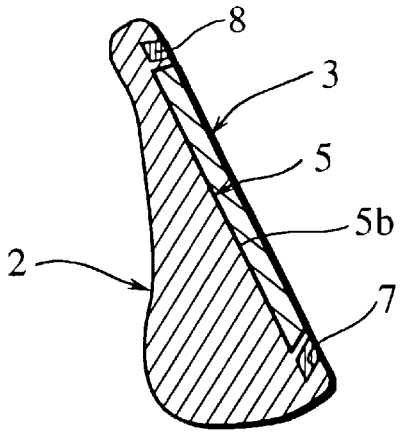
FIG. 9 is a cross-sectional view showing a modification example of the preferred embodiment in FIG. 8.

As a modification example shown in FIG. 9, the concave portion 5 may be formed as to be a shallow dish of which bottom face 5*b* is entirely closed.

And, in FIG. 1 and FIGS. 3A and 3B, or FIG. 7 and FIGS. 3A and 3B, the thickness dimension T of the side wall 6, which divides the concave portion 5 and the concave groove 7, is set to be about 0.5 mm to 3.0 mm. And, cross-sectional shape of the concave groove 7 is arranged as that an inner face of the side wall 6 side is vertical, and an inner face of an outer side is a slope 12 with which the width of the concave groove 7 enlarges toward the bottom side.

A depth dimension D of the chamfer 9 formed on the peripheral portion 3*a* of the face body 3 is arranged to be $0.3A \leqq D \leqq 1.0A$ (A represents thickness dimension of the face body 3), and an inclination angle θ of the chamfer 9 is arranged to be $15° \leqq \theta \leqq 45°$. Preferably, the depth dimension D is arranged to be $0.4A \leqq D \leqq 0.6A$, and the inclination angle θ is arranged to be $20° \leqq \theta \leqq 30°$. Because if the depth dimension D is under the lower limit value, the side wall 6 is difficult to be deformed, a holding part of the side wall 6 that holds the face body 3 to prevent the face body 3 from falling is small, and fixation of the face body 3 becomes unstable. Reversely, if the depth dimension D is over the upper limit value, the side wall 6 needs to be greatly deformed, and this makes the deformation difficult. And it is useless to deform the side wall 6 unnecessarily and greatly. If the inclination angle θ is under the lower limit value, the holding part of the side wall 6 that holds the face body 3 to prevent the face body 3 from falling is small, and fixation of the face body 3 becomes unstable. Reversely, if the inclination angle θ is over the upper limit value, the side wall 6 needs to be excessively deformed, and this makes the production of the golf club head difficult.

And, a depth dimension B of the concave groove 7, which is arranged depending on the thickness dimension A of the face body 3, is arranged to be a range of $0.5A \leqq B \leqq 1.0A$. If the depth dimension B is under the lower limit value, the deformation of the side wall 6, which is accompanied by the plastic deformation of the caulking member 8, becomes insufficient. If the depth dimension B is over the upper limit value, plastic deformation working amount of the caulking member 8 becomes excessive, and this makes the working difficult.

Next, press-fit plastic working of the caulking member 8 and the deformation of the side wall 6 will be described. In FIG. 3A, the caulking member 8 of rectangle cross section is placed in the concave groove 7, pressed in a direction of arrow C by a press machine, and worked with compression plastic deformation. In this process, the side wall 6 of the thickness dimension T receives a strong pressure in horizontal direction (a pressure in a direction toward the right side in FIG. 3A) from the caulking member 8 filled in the concave groove 7, and elastically or plastically deforms until adheres to the chamfer 9 of the face body 3.

Then, finishing works such as cutting are conducted on the face (needless raising of the caulking member 8 and needless protrusion of the side wall 6 are ground away), and the golf club head becomes a state of finished product shown in FIG. 3B.

As clearly shown in FIG. 1 or FIG. 7, the concave groove 7 is formed with intervention of the former-described dimension T as to surround periphery of the concave portion 5, and be a closed ring (loop).

Figure 10A:
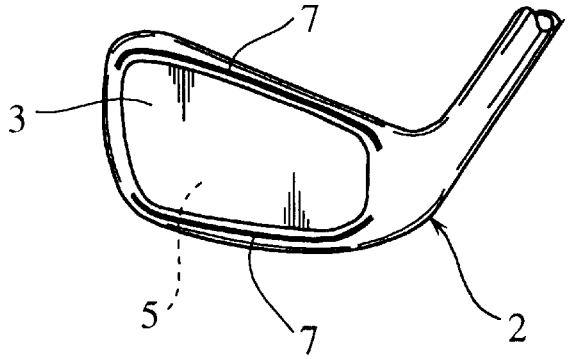
FIG. 10A is a schematic front view showing still another preferred embodiment of the present invention.
Figure 10B:
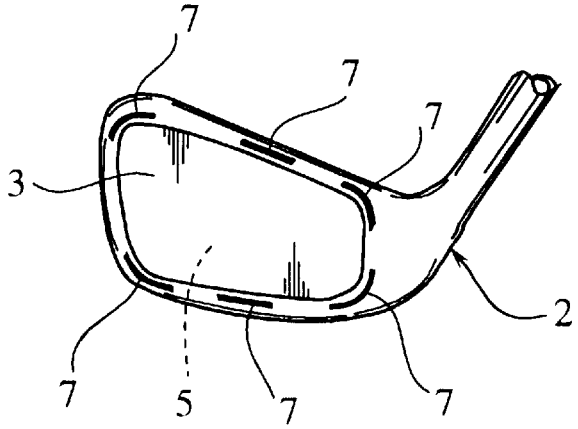
FIG. 10B is a schematic front view showing still another preferred embodiment of the present invention.

FIGS. 10A and 10B show modification examples of the concave groove 7, in which concave grooves 7 are formed intermittently along the periphery of the concave portion 5. In FIG. 10A, for example, concave grooves 7 are disposed on an upper side and an lower side of the concave portion 5. And in FIG. 10B, the concave grooves 7 are disposed on 4 corners, a part of the upper side, and a part of the lower side of the concave portion 5. As a matter of course, the concave grooves 7 may be disposed intermittently (or interruptedly) in other arrangements.

Figure 4A:
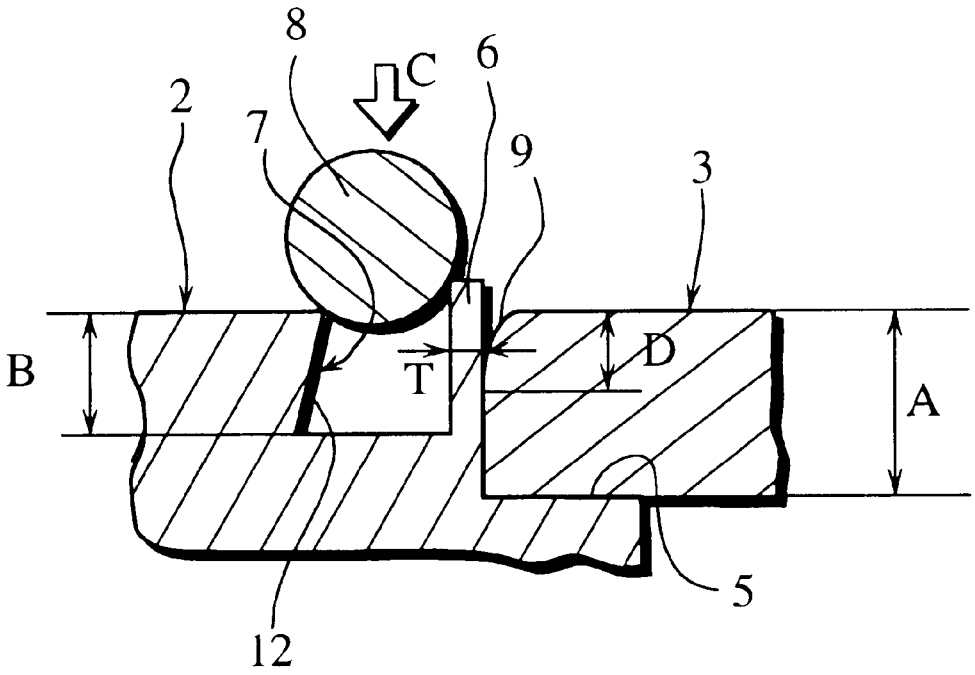
FIG. 4A is an explanatory cross-sectional view of an enlarged principal portion showing another preferred embodiment of the present invention.
Figure 4B:
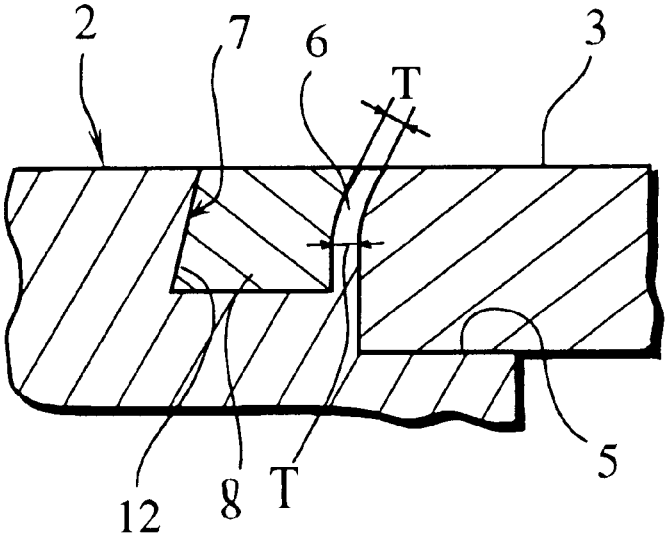
FIG. 4B is an explanatory cross-sectional view of an enlarged principal portion showing another preferred embodiment of the present invention.

Next, in another embodiment shown in FIGS. 4A and 4B, the chamfer 9 of the face body 3 is a round slope (or round chamfer), the caulking member 8 is circular in cross section before the press-fit plastic deformation. Except for these, this is similar to the embodiment shown in FIGS. 3A and 3B.

An advantage of this case shown in FIGS. 4A and 4B is that stress concentration is not generated in the side wall 6 for the curved arc shape of the side wall 6 after the deformation. With this advantage, although the thickness dimension T is small, the side wall 6 does not generate cracks.

Figure 5A:
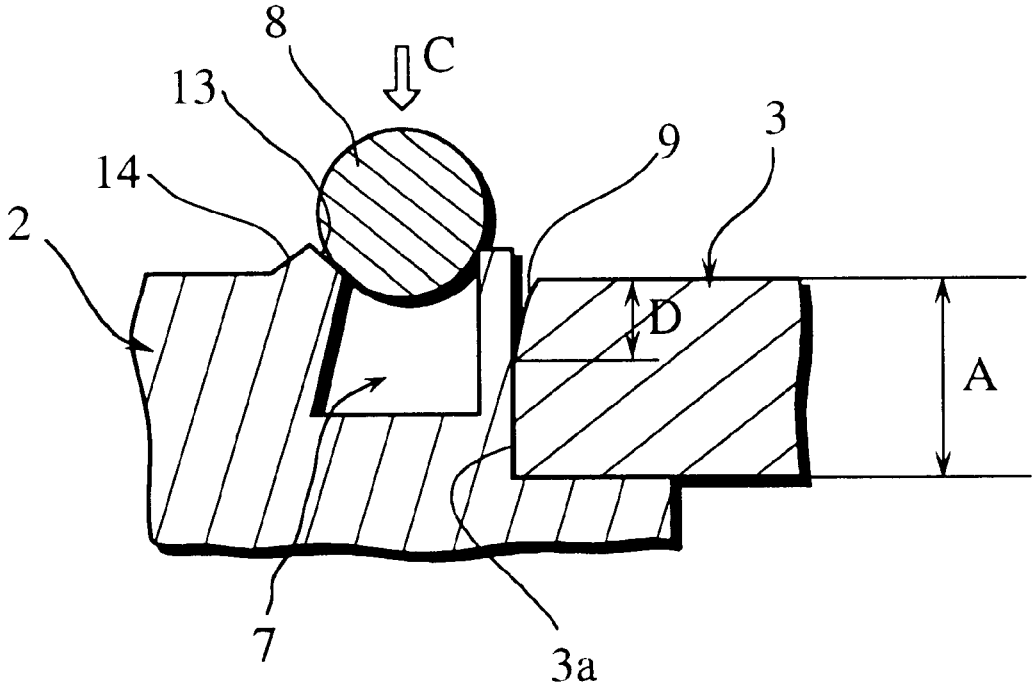
FIG. 5A is an explanatory cross-sectional view of an enlarged principal portion showing still another preferred embodiment of the present invention.
Figure 5B:
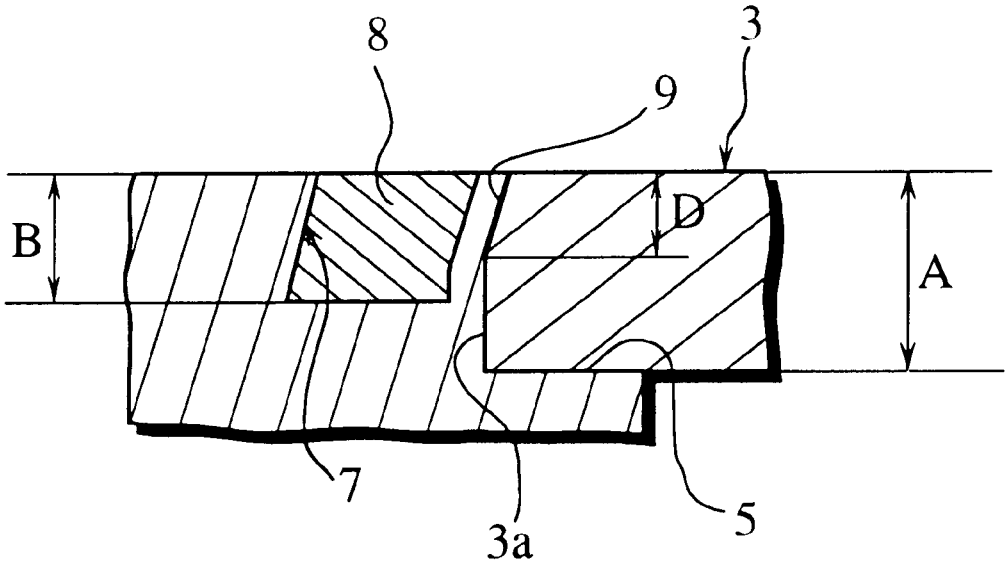
FIG. 5B is an explanatory cross-sectional view of an enlarged principal portion showing still another preferred embodiment of the present invention.

Next, in still another embodiment shown in FIGS. 5A and 58, the chamfer 9, which is straight same as in FIGS. 3A and 3B, is formed on the face body 3, and the caulking member 8 is circular in cross section same as in FIGS. 4A and 4B. Although configuration of the concave groove 7 is approximately same as in FIGS. 3A and 3B, and FIGS. 4A and 4B, a small protruding portion 14 having a guide slope 13, which leads the caulking member 8, is formed beforehand at an opening of the concave groove 7. In the finishing works such as cutting conducted after the press-fit plastic deformation (crush) of the caulking member 8, the small protruding portion 14 is removed together with the excessive protrusion of the caulking member 8, and this makes the golf club head as shown in FIG. 5B.

Figure 6A:
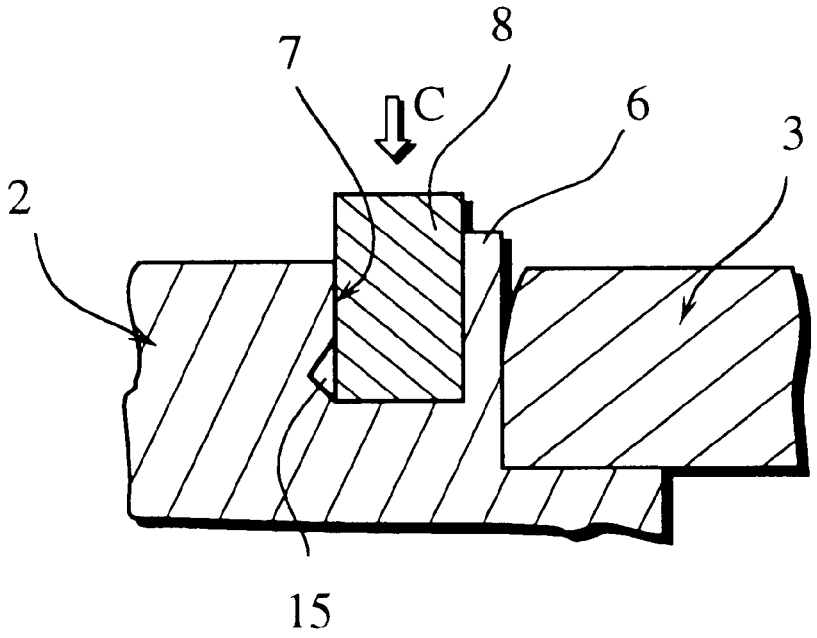
FIG. 6A is an explanatory cross-sectional view of an enlarged principal portion showing further preferred embodiment of the present invention.
Figure 6B:
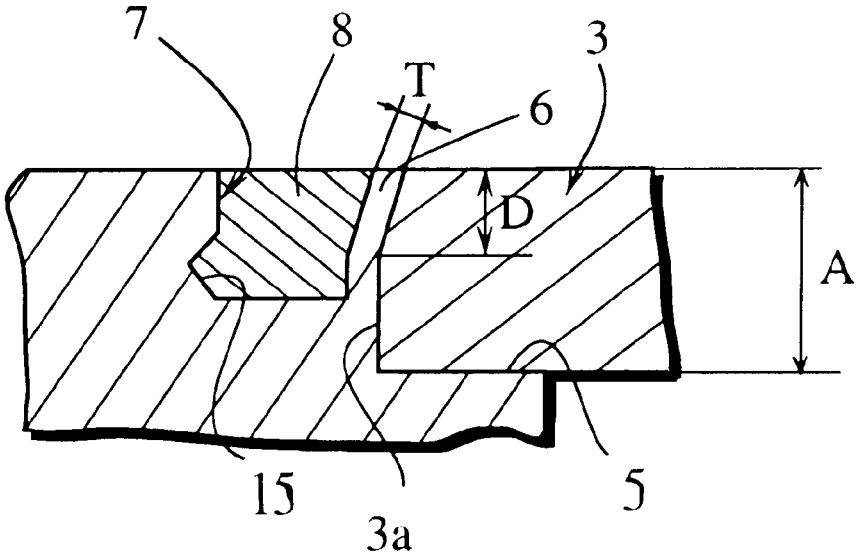
FIG. 6B is an explanatory cross-sectional view of an enlarged principal portion showing further preferred embodiment of the present invention.

Next, although a further embodiment shown in FIGS. 6A and 6B is basically same as the embodiment shown in FIGS. 3A and 3B, cross-sectional shape of the concave groove 7 is different. That is to say, instead of the slope 12 in FIGS. 3A and 3B, a small side concave groove portion 15 is formed on the inner face of the outer side of the concave groove 7 in FIGS. 6A and 6B. As shown in FIG. 6B, the caulking member 8 is prevented from falling by sure holding in the concave groove 7 by the small side concave groove portion 15. Although the small side concave groove portion 15 is triangle in cross section in FIGS. 6A and 6B, other configurations may be used. The configuration of the small side concave groove portion 15, however, needs to be a configuration that the caulking member 8 can easily get in with plastic deformation, as shown in FIG. 6A or FIG. 6B.

As materials for the face body 3, materials that are difficult to be plastically deformed such as amorphous metal, titanium, titanium alloy, tungsten, ceramic, etc. are used. On the other hand, as materials for the head main body 2, materials that are relatively hard and of high yield point such as titanium, titanium alloy, etc. are used.

And, as materials for the caulking member 8, for example, brass, copper, gold, silver, stainless steel, etc. are used. That is to say, for the caulking member 8, materials that are easier than the materials for the head main body 2 and the face body 3 to be plastically deformed, or of low yield point.

Although the head main body 2 is made of the materials of high yield point that are difficult to be plastically deformed, the side wall 6 having small (thin) dimension T is deformable toward the peripheral portion 3*a* of the face body 3 by the side pressure of the caulking member 8 being press-fitted into the concave groove 7 within its elastic range or its plastic range. Therefore, if the head main body 2 and the face body 3 are made of dissimilar materials that are difficult to be plastically deformed, the face body 3 can be fixed to the head main body 2 certainly and firmly by the press-fit plastic deformation of the caulking member 8 and the (accompanying) deformation of the side wall 6 of the small thickness dimension T. And, generation of looseness and gaps at the fixed part can be prevented in actual use.

Further, in each embodiment shown in FIG. 3A through FIG. 6B, the peripheral portion 3*a* of the face body 3 can be adhered (tightly fitted) directly to the inner peripheral surface 5*a* of the concave portion 5 of the head main body 2. An advantage of accurate positioning of the face body 3 to the head main body 2 is obtained thereby.

Especially, in FIG. 3A through FIG. 6B, even if the caulking member 8 is press-fitted into the concave groove 7 sequentially with changing the press-fit working position in longitudinal direction of the concave groove 7, there is an advantage that dislocation of the face body 3 to the head main body 2 is not generated. (That is to say, in a conventional construction disclosed by Japanese Patent Provisional Publication No. 8-252344, dislocation of a face body is generated, and especially, dimension between the face body and a head main body becomes ununiform because the face body contacts a caulking member directly. This disadvantage is solved in the present invention.)

In the present invention, as described above, the head main body 2 made of a high spring back material (a material of high yield point) contacts the face body 3 at the side wall 6 of thin thickness dimension T, and the face body 3 can be connected with the main body 2 elastically by pushing the side wall 6 with a third object (the caulking member 8).

Therefore, although the face body 3 of plate shape generates elastic deformation by impact force when the golf club head collides a golf ball, the face body 3 can be held elastically, and generation of gaps between the face body and the side wall 6 is prevented.

And, with the above described construction of the present invention, even if the head main body is made of titanium or titanium alloy having high deformation resistance in plastic working and high spring back, length of a part to be deformed of the head main body 2 (length of the side wall 6 in longitudinal direction) is long, the part is sequentially deformed with the press-fit plastic working of the caulking member 8, the deformation resistance of the side wall 6 is made small, and the working becomes easy thereby. Further, deformed state of the side wall 6 (refer to FIG. 3B, FIG. 4B, FIG. 5B, and FIG. 6B ) is kept by the plastic deformation of the caulking member 8, and the spring back of the side wall 6 can be effectively prevented.

And, working efficiency is improved by that the caulking member 8 is made of a material easier than the materials of the head main body 2 and the face body 3 to be plastically deformed. And, the golf club head hardly receives damage caused by deformation and rubbing of the caulking member 8 because the caulking member 8 does not contact the face body 3 directly. Therefore, in fixing (connecting) construction of the present invention, easy material and difficult material for plastic working are ingeniously connected.

And, moment of inertia of the golf club head 1 can be increased with the head main body 2 made of titanium or titanium alloy having low specific gravity and high strength, combination effect relating to differences among the requirement characteristics of each part of the head is effectively demonstrated. Especially, when the face body 3 is made of amorphous metal, the club head shows high repulsiveness to the ball for low elastic modulus and high strength of the amorphous metal.

And, as shown in FIG. 3A through FIG. 68, the caulking member 8 gets into the concave groove 7 which enlarges toward the bottom, or the small side concave groove portion 15, resistance against falling of the caulking member 8 is increased, and further certain fixing is realized thereby.

The present invention can be applied to putter type golf club heads, etc. as well as wood type golf club heads and iron type golf club heads.

The present invention is appropriate for wood type and iron type golf club heads of which impact force is high when they hit golf balls, and especially, the most appropriate for wood type golf club heads which receive high impact force.

Next, an example of the present invention will be described.

A club head of a fitting (connecting) construction as shown in FIGS. 5A and 5B is produced. The head main body is made of 6A1-4V titanium alloy, the face body 3 is made of Zr series amorphous alloy (Zr55A1 10Ni5Cu30), and the caulking member 8 is made of stainless steel (SUS630). The caulking member 8 is worked with press-fit plastic deformation, and then, face side is polished.

As a result, the club head can be press-worked within approximately same working time of a conventional club head made of stainless steel (SUS630, for example), and no gap is observed between the caulking member 8 and the side wall 6, and between the side wall 6 and the peripheral portion 3*a* of the face body 3.

According to a golf club head of the present invention, even if the head main body 2 is made of difficult materials to be plastically deformed such as titanium alloy, etc., and the face body 3 is also made of difficult materials to be plastically worked such as amorphous alloy, etc., the face body 3 can be fixed efficiently, stably, and certainly. That is to say, spring back of the side wall 6 is restrained with the lateral pressure of the caulking member 8 in the concave groove 7, and the face body 3 can be effectively and elastically connected through the side wall 6. Therefore, if the face body 3 momentarily generates elastic deformation by impact force of ball hitting, the elastically connected side wall 6 can certainly hold the face body 3, the face body does not fall even after a long period of use, and does not generate gaps on a boundary line with the head main body 2.

And, in case that the head main body 2 has a small side concave groove portion 15, the plastically deformed caulking member 8 gets into the small side concave groove portion 15, the resistance against falling of the caulking member 8 is increased, and this makes further certain fixation.

Further, the golf club head hardly receives damages caused by deformation and rubbing of the caulking member 8 because the caulking member 8 does not contact the face body 3 directly, and the golf club head has high durability.

And, according to a golf club head of the present invention, the golf club head can be worked efficiently with a small press machine when the caulking member 8 is worked with press-fit plastic deformation in longitudinal direction of the concave groove 7 sequentially, since dimension of the concave groove 7 and the caulking member 8 is long. Moreover, the face body 3 is certainly fixed by the minimum press-fit plastic deformation working.

Further, working for press-fit of the caulking member 8 into the concave groove 7 becomes easy, and synergistic effect of organic combination of the side wall 6 and the head main body 2 made of materials of high yield point is increased.

Moreover, according to a golf club head of the present invention, the moment of inertia of the club head 1 can be increased, and the combination effect relating to differences among the requirement characteristics of each part of the head is sufficiently shown. And, in case that amorphous metal is used as the material of the face body 3, high repulsiveness can be obtained by the low elastic modulus and the high strength of the amorphous metal.

While preferred embodiments of the present invention have been described in this specification, it is to be understood that the invention is illustrative and not restrictive, because various changes are possible within the spirit and the indispensable features.

What is claimed is:

1. A golf club head comprising a construction in which a concave portion for fitting a face body is formed on a face side of a head main body, a concave groove is formed along an inner peripheral surface of the concave portion with a side wall of small thickness dimension, a caulking member is press-fitted into the concave groove with plastic deformation, the side wall is deformed toward a peripheral portion of the face body, and the head main body and the face body are connected and fixed.

2. The golf club head as set forth in claim 1, wherein the concave groove is formed as a closed ring as to surround a periphery of the concave portion.

3. The golf club head as set forth in claim 1, wherein the concave groove is formed along the periphery of the concave portion intermittently.

4. The golf club head as set forth in claim 1, wherein the caulking member is made of a material which is easier to plastically deform than materials of the head main body and the face body.

5. The golf club head as set forth in claim 1 or claim 4, wherein the head main body is made of titanium.

6. The golf club head as set forth in claim 1 or claim 4, wherein the head main body is made of titanium alloy.

7. The golf club head as set forth in claim 1 or claim 4, wherein the face body is made of amorphous metal.

8. The golf club head as set forth in claim 1 or claim 4, wherein the head main body is made of titanium, and the face body is made of amorphous metal.

9. The golf club head as set forth in claim 1 or claim 4, wherein the head main body is made of titanium alloy, and the face body is made of amorphous metal.

10. The golf club head as set forth in claim 1, 2, 3, or 4, wherein the concave groove has a small side concave groove portion on an inner surface of an outer side of the concave groove.

* * * * *